US006896434B2

(12) United States Patent
Ohba et al.

(10) Patent No.: US 6,896,434 B2
(45) Date of Patent: May 24, 2005

(54) STICK TYPE COSMETIC MATERIAL FEEDING CONTAINER

(75) Inventors: Atsushi Ohba, Tokyo (JP); Tadasuke Adachi, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/606,765

(22) Filed: Jun. 27, 2003

(65) Prior Publication Data

US 2004/0161284 A1 Aug. 19, 2004

(30) Foreign Application Priority Data

Jan. 28, 2003 (JP) ..... 2003-018594

(51) Int. Cl.[7] ..... B43K 21/00
(52) U.S. Cl. ..... 401/70; 401/75
(58) Field of Search ..... 401/70, 75, 76, 401/77, 78, 68, 92

(56) References Cited

U.S. PATENT DOCUMENTS 6,155,734 A * 12/2000 Kageyama et al. ..... 401/75

FOREIGN PATENT DOCUMENTS

JP 60-161925 10/1985

* cited by examiner

*Primary Examiner*—David J. Walczak
(74) *Attorney, Agent, or Firm*—Rabin & Berdo P.C.

(57) ABSTRACT

In a stick type cosmetic material feeding container 1, a stick type cosmetic material A retained at a front end of a core chuck member 30 moves in an axial direction in a front cylinder 10 by a feeding mechanism due to rotary operation of the front cylinder 10 and a base cylinder 20. A cylindrical body 34 which defines the advance limit and retreat limit of a feeding stroke is installed at a rear part of the core chuck member 30. Elastic engagement projections 37 which are spirally engaged with a roulette-shaped spiral 22 of the base cylinder 20 and have elasticity are installed at an outer circumference of the cylindrical body 34. Further, the cylindrical body 34 is provided with an elastic slit 34*c* for absorbing a shock in an axial direction. When the engagement projections 37 go over the spiral 22 and make clutch rotations at least at the retreat limit of the core chuck member 30, the elastic slit 34*c* attenuates the shock in an axial direction to the core chuck member 30 which has arisen resulting from the clutch rotations.

11 Claims, 15 Drawing Sheets

(A)

(B)

(A)

(B)

(C)

(A)

(B)

STICK TYPE COSMETIC MATERIAL FEEDING CONTAINER

BACKGROUND OF THE INVENTION

1. Field of the Invention

The present invention relates to a stick type cosmetic material feeding container, such as an eyebrow pencil, an eyeliner, a lip liner, and the like. It particularly relates to a feeding container which has a function of protecting a stick type cosmetic material and a feeding mechanism at the time of an overrun (a disconnection of spiral engagement) when the stick type cosmetic material is fed out or retracted.

2. Description of the Related Art

Various stick type cosmetic material feeding containers in which a core material having a thin diameter, such as an eyebrow pencil, an eyeliner, and the like, is inserted, respectively, have been invented since way back.

A proposal shown in FIG. 15 is made in Japanese Utility Model Laid-Open Publication No. Sho 60-161925 for the purpose of particularly protecting a feeding mechanism. The constitution is such that due to rotary operation of a cylindrical body 10 and a cylindrical body with a screw 22, a core material 30 retained at a front end of a built-in supporting body 32 is caused to advance and retreat through an opening section 14 of the cylindrical body 10. A stepped section 16 of the cylindrical body 10 is inserted into the cylindrical body with a screw 22 and a projection section 18 of the cylindrical body 10 fits in a groove 26, whereby the cylindrical body 10 and the cylindrical body with a screw 22 can make relative rotations.

A slit 38 is provided at a rear end of the supporting body 32 so as to impart elasticity to the rear end, and a projection 36 is installed at the rear end. The projection 36 is spirally engaged with a female screw section 24 of the cylindrical body with a screw 22. Further, due to engagement of a linear projection rail 40 and a guide groove 20, the supporting body 32 and the cylindrical body 10 do not make relative rotations and the supporting body 32 is capable of shifting only in an axial direction, thereby constituting a feeding mechanism. The slit 38 shrinks in diameter at the feeding advance and retreat limits due to an exceeding rotary load, and the projection 36 goes over a ridge of the female screw section 24 and makes a clutch rotation. Thus, a further shift of the supporting body 32 is prevented for safety measures of the feeding mechanism.

However, in this case, there is a problem, for example, such that when the projection 36 goes over the female screw section 24 due to a clutch rotation at the retreat limit, the core material 30 retained by the supporting body 32 is gradually swerved in a direction of advance from the supporting body 32 due to a shock which has arisen and the core material 30 is finally removed from the supporting body 32.

This swerve phenomenon of a stick type cosmetic material will be described further. When the projection 36 goes over the female screw section 24 at the retreat limit, the supporting body 32 and the core material 30 are accelerated in such a manner that the supporting body 32 and the core material 30 are pushed out in a direction of the opening section 14. Thus, a momentum expressed in an equation p=mv (p: momentum, m: weight, and v: velocity) is given to the supporting body 32 and the core material 30.

Next, when the projection 36 which has gone over the ridge of the female screw section 24 comes into contact with the next ridge of the female screw section 24, the supporting body 32 momentarily loses the velocity v and therefore only the core material 30 has the momentum.

If the momentum of the core material 30 is greater than frictional force to hold the core material 30 at the supporting body 32, the core material 30 will move in a direction of the opening section 14 from the supporting body 32 (swerve of the stick type cosmetic material). If the movement is repeated, the core material 30 will come out of the supporting body 32 in a short time.

The present invention is directed to solve such problems.

More specifically, an advantage of the present invention is to provide a stick type cosmetic material feeding container capable of minimizing a momentum which is applied to a stick type cosmetic material at the time of a clutch rotation at the stroke limit.

A further advantage of the present invention is to provide a feeding container which performs smooth feeding and is safe for a stick type cosmetic material although being simple in structure.

SUMMARY OF THE INVENTION

The present invention is a stick type cosmetic material feeding container in which a front cylinder and a base cylinder are coaxially connected in such a manner that the front cylinder and the base cylinder can freely make relative rotations, and a core chuck member retaining a stick type cosmetic material by means of a stick type cosmetic material retaining section is arranged in the front cylinder and which has a feeding mechanism for causing the core chuck member to make a feeding stroke in an axial direction due to relative rotations of the front cylinder and the base cylinder. A spiral groove is formed on an inner circumferential surface of the base cylinder.

The core chuck member comprises:

a shaft extending from the stick type cosmetic material retaining section;

a cylindrical body which is installed at an edge of the shaft, comes into contact with a part of the front cylinder and a part of the base cylinder at the advance limit and the retreat limit of a feeding stroke of the core chuck member, respectively, and defines the advance limit and the retreat limit, respectively;

an engagement projection which is installed at an outer circumference of the cylindrical body and elastically and spirally engaged with the spiral groove; and a shock absorbing section which is formed at the cylindrical body and absorbs a shock in an axial direction. When the engagement projection goes over the spiral groove and makes a clutch rotation due to a further rotary load on the core chuck member at least at the retreat limit of the core chuck member, the shock absorbing section absorbs a shock in an axial direction to the core chuck member which has arisen resulting from the clutch rotation.

As described above, in the present invention, when a further rotary load is applied at the advance limit or the retreat limit, the core chuck member makes a clutch rotation with respect to the base cylinders thereby preventing the feeding mechanism and the stick type cosmetic material from being damaged. Further, the shock absorbing section of the core chuck member absorbs a shock which arises at the time of a clutch rotation at the retreat limit and acts on in an axial direction. Thus, the stick type cosmetic material is prevented from swerving in a direction of advance from the stick type cosmetic material retaining section.

BRIEF DESCRIPTION OF THE DRAWINGS

FIG. 5(A) shows a front cylinder, FIG. 5(B) shows a core chuck member, and FIG. 5(C) shows a base cylinder.

DESCRIPTION OF THE PREFERRED EMBODIMENTS

Embodiments of the present invention will be described based on the accompanying drawings.

A stick type cosmetic material feeding container 1 according to a first embodiment of the present invention will be described with reference to FIGS. 1 through 5.

Figure 1:
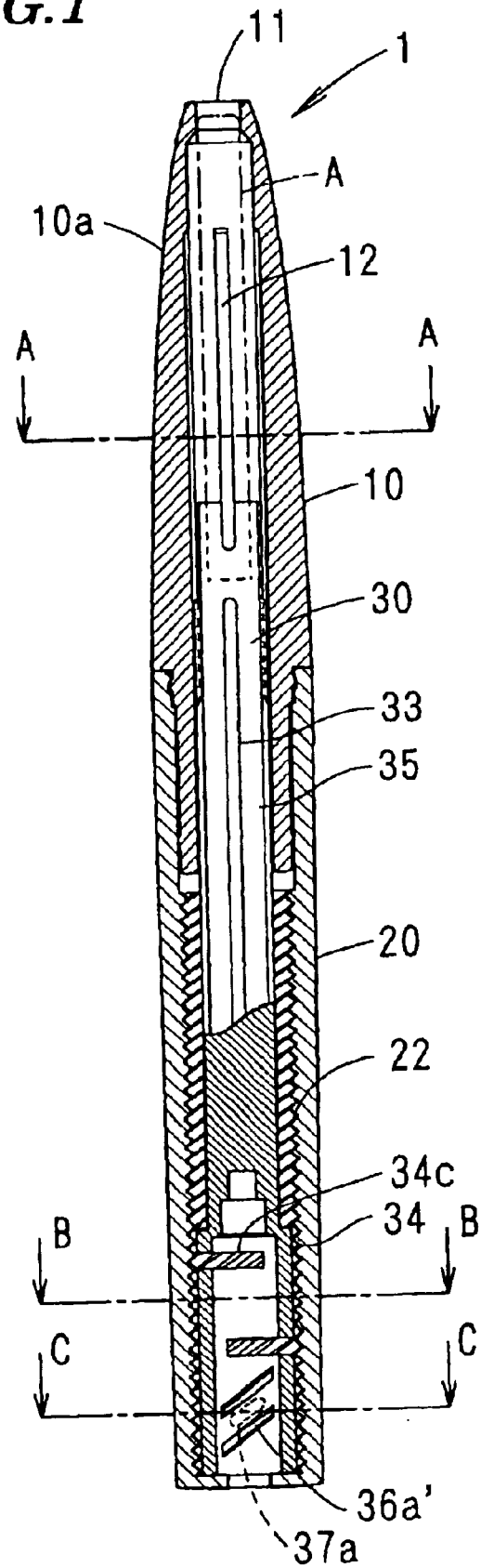
FIG. 1 is a partially longitudinal section showing a stick type cosmetic material feeding container according to a first embodiment of the present invention.
Figure 2:
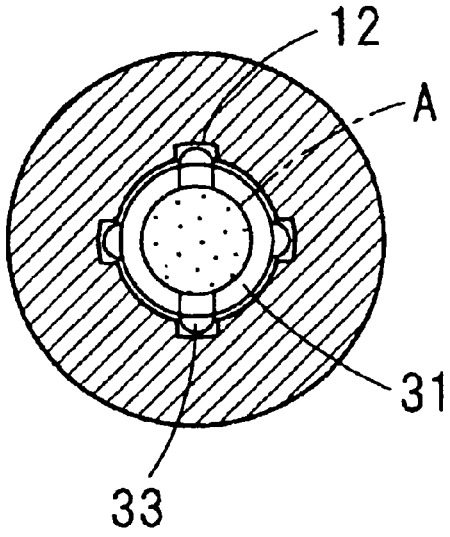
FIG. 2 shows a sectional view taken along line A—A and a sectional view taken along line B—B shown in FIG. 1, respectively.
Figure 2:
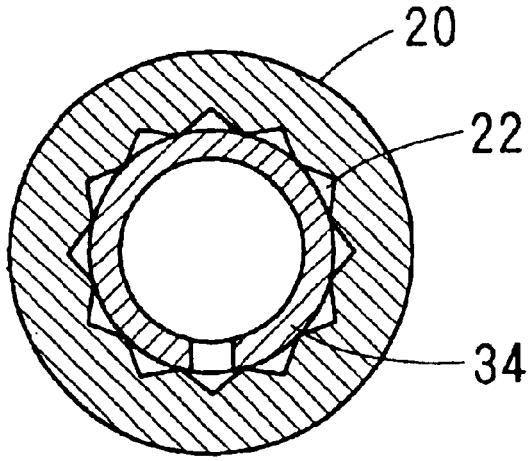
Figure 5:
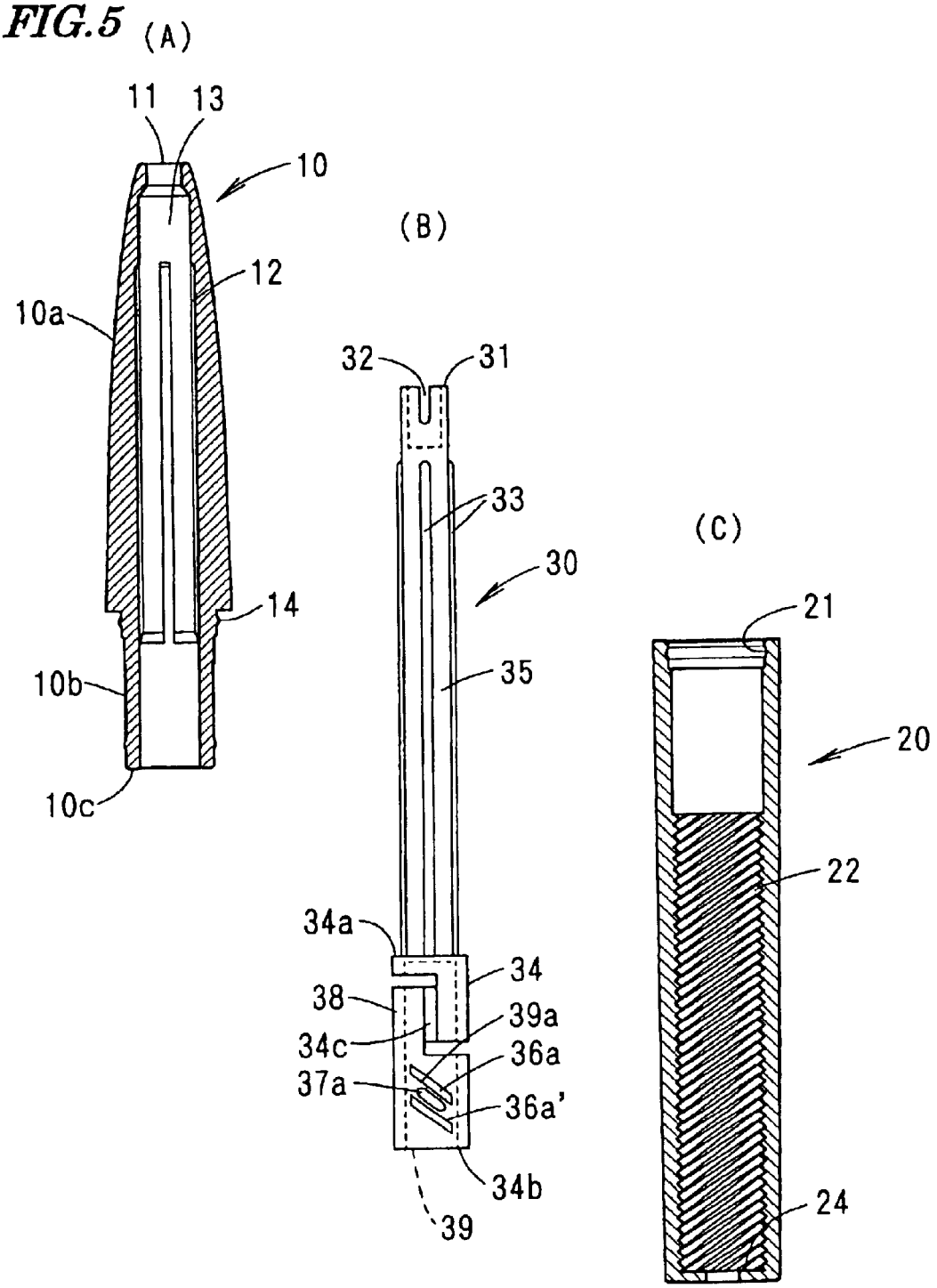
FIG. 5 shows each member of the stick type cosmetic material feeding container according to the first embodiment shown in FIG. 1.

As clearly shown in FIGS. 1 and 5, a front cylinder 10 comprises a pinch section 10*a* and a base cylinder fit-in section 10*b*. A front end opening hole 11 through which a stick type cosmetic material A advances and retreats is provided at the front cylinder 10 and a through hole 13 is bored from the front end opening hole 11. Further, a slide groove 12 which is used as a rotation regulating mechanism together with a core chuck member 30 and extends vertically is provided at an inner circumference of the through hole 13.

A fit-in concave section 21 to be engaged with a projection 14 provided at the base cylinder fit-in section 10*b* of the front cylinder 10 is formed at a front end inner diameter of a base cylinder 20 to be combined with the front cylinder 10. Further, a roulette-shaped spiral (multi-thread spiral) 22 which is longer than a feeding stroke length is provided in an axial direction at an inner circumference of the base cylinder 20.

This roulette-shaped spiral 22 is formed by resin molding. It is preferable that the roulette-shaped spiral 22 has few tapers for pattern drawing and a cross section of the spiral from the beginning to the end is finished in almost uniform size.

The front cylinder 10 and the base cylinder 20 are rotatably connected.

The core chuck member 30 to be inserted in the front cylinder 10 and the base cylinder 20 has a stick type cosmetic material retaining section 31 which a vacant section 32 is provided at its front end. Further, the core chuck member 30 has a shaft 35 and a vertical rib 33 (a linear projection) to be engaged with the slide groove 12 of the front cylinder 10 is arranged at an outer circumference of the shaft. Due to the engagement of the vertical rib 33 and the slide groove 12, the core chuck member 30 does not rotate relatively to the front cylinder 10 and slides only in an axial direction, thereby constituting the rotation regulating mechanism.

A cylindrical body 34 whose diameter is larger than that of the shaft 35 is installed at a rear part of the shaft 35. Inclined parallel slits 36*a* and 36*a*' are formed at an outer wall 38 of the cylindrical body 34, and a fraction 39*a* is installed between the slits 36*a* and 36*a*'. Further, inclined parallel slits 36*b* and 36*b*' are similarly formed on the opposite side, and a fraction 39*b* is formed between the slits 36*b* and 36*b*'. Engagement projections 37*a* and 37*b* are diagonally installed on the fractions 39*a* and 39*b*, respectively. These engagement projections 37*a* and 37*b* are spirally engaged with the roulette-shaped spiral 22 provided at an inner circumference of the base cylinder 20, thereby constituting a feeding mechanism.

Feeding operation of a stick type cosmetic material feeding container 1 will be explained with reference to FIG. 1.

When the front cylinder 10 and the base cylinder 20 are mutually rotated, the vertical rib 33 of the core chuck member 30 and the slide groove 12 provided in the front cylinder 10 are engaged and therefore the rotation regulating mechanism operates. Also, due to spiral engagement of the roulette-shaped spiral 22 in the base cylinder 20 and the engagement projections 37*a* and 37*b* installed at the outer wall 38 of the cylindrical body 34 of the core chuck member 30, the feeding mechanism operates and the core chuck member 30 is fed out. The stick type cosmetic material A retained by the cavity section 32 of the stick type cosmetic material retaining section 31 advances through the front end opening hole 11 of the front cylinder 10 while rotating synchronously with the front cylinder 10. The stick type cosmetic material can be used in this state.

Further, when the front cylinder 10 and the base cylinder 20 are rotated in reverse, the stick type cosmetic material A is completely housed in the front cylinder 10 due to the mechanism described above.

In this case, as far as the feeding mechanism is concerned, a single thread spiral groove or a double thread spiral groove may be sufficient as a substitute for the roulette-shaped spiral 22 in the base cylinder 20. However, if a roulette-shaped spiral is used and the following constitution (1) and (2) is combined, the characteristics described below can be imparted.

Figure 3:
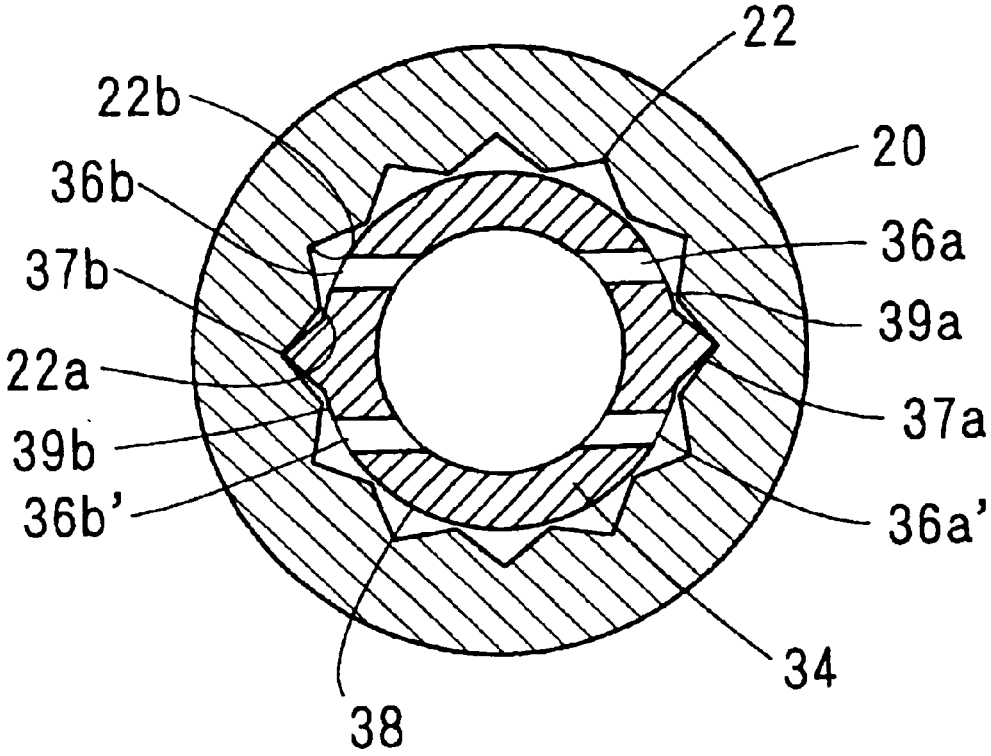
FIG. 3 is a sectional view taken along line C—C of FIG. 1.

(1) As shown in FIG. 3, roots 22*b* and ridges 22*a* of the roulette-shaped spiral 22 are formed in the base cylinder 20. The outer wall 38 of the cylindrical body 34 is formed such that its diameter is slightly smaller than a circumference which links ridges 22*a* shown in the cross section of the roulette-shaped spiral 22 in the base cylinder 20. The engagement projections 37*a* and 37*b* which are installed at the outer wall 38 and have elasticity are caused to be spirally engaged with the ridges 22*b* of the roulette-shaped spiral 22.

(2) A pair of hooked slits 34*c* (elastic slits) are provided in an axial direction at the cylindrical body 34. Also, a pair of parallel slits inclined in the same direction as that of a slope of the roulette-shaped spiral 22 in the base cylinder 20 are formed as 36*a* and 36*a*' and 36*b* and 36*b*'. The engagement projections 37*a* and 37*b* are installed on surfaces of the fractions 39*a* and 39*b* formed due to the parallel slits.

Figure 4:
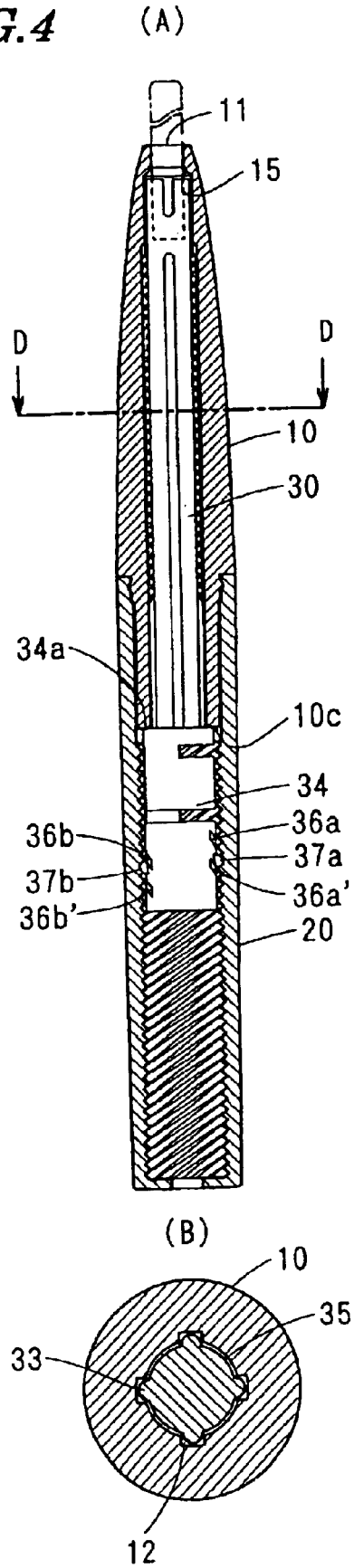
FIG. 4(A) shows a state in which the stick type cosmetic material feeding container of FIG. 1 is at the feeding uppermost limit.
FIG. 4(B) is a sectional view taken along line D—D.

FIG. 4 shows a state in which the core chuck member 30 is fed up to the uppermost limit of the feeding stroke. By bringing a front end section 34*a* of the cylindrical body 34 of the core chuck member 30 into contact with a rear end section 10*c* of the front cylinder 10, the uppermost limit is defined.

If a further rotary load to cause the core chuck member 30 to go up is applied at this time, the engagement projections 37*a* and 37*b* which are elastically and spirally engaged with the roots 22*b* of the roulette-shaped spiral 22 of the base cylinder 20 will easily separate from the spiral engagement. Further, by making a reverse rotation, the spiral engagement will easily be restored. Thus, clutching takes place making a sound of ticktack and also it will be possible to immediately draw the core chuck member 30 in the front cylinder 10 if the reverse rotation is made. This protects the stick type cosmetic material A and the feeding mechanism from the rotary load at the uppermost limit.

Further, due to rotations of the front cylinder 10 and the base cylinder 20, the cylindrical body 34 of the core chuck member 30 slides in the base cylinder 20 with the outer wall 38 of the cylindrical body 34 being always supported by the ridges 22*a* of the roulette-shaped spiral 22 of the base cylinder 20. Thus, the core chuck member 30 can move in the stick type cosmetic material feeding container 1 without wobbling from side to side. This further improves smoothness and safety of feeding.

Further, the parallel slits 36*a* and 36*a*' and 36*b* and 36*b*' inclined in the same direction as that of the slope of the roulette-shaped spiral 22 provided in the base cylinder 20 are installed at the outer wall 38 of the cylindrical body 34 of the core chuck member 30. By installing the engagement projections 37*a* and 37*b* on surfaces of the fractions 39*a* and 39*b* formed due to the parallel slits, the engagement projections 37*a* and 37*b* can be set to be long and the engagement projections 37*a* and 37*b* can securely and spirally be engaged with the ridges 22*b* of the roulette-shaped spiral 22.

Figure 15:
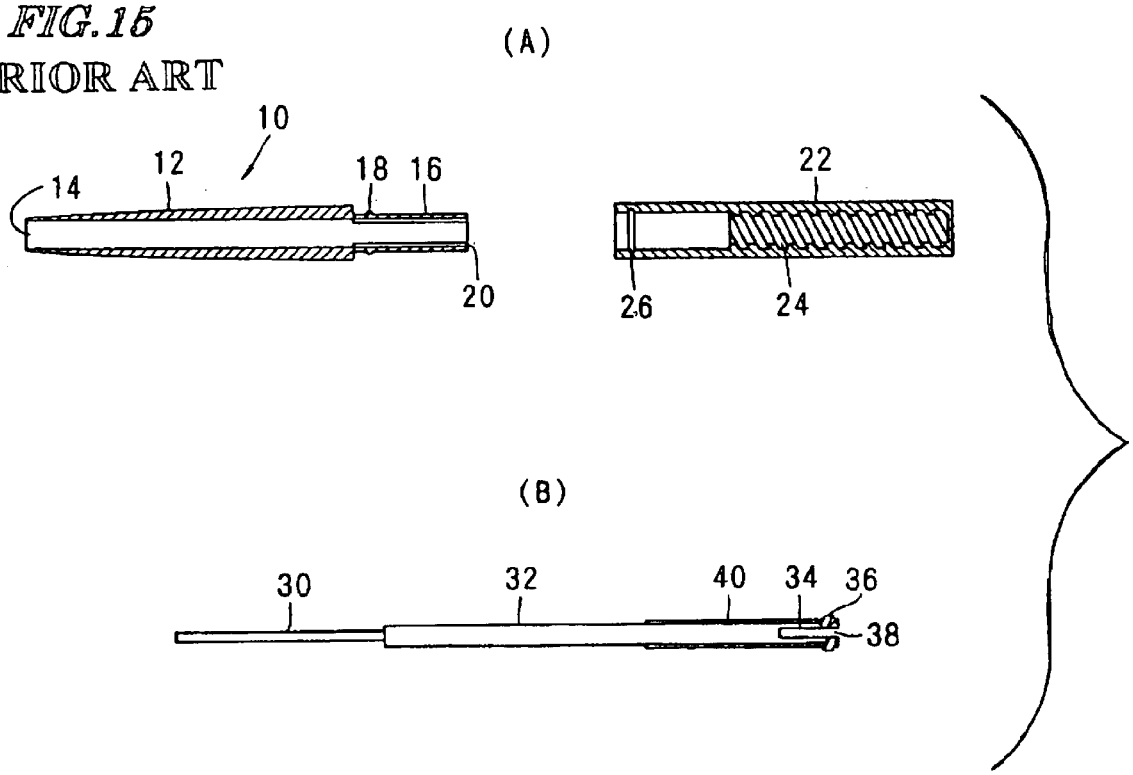
FIG. 15 PRIOR ART
FIG. 15 shows a conventional example.

Further, the engagement projections 37*a* and 37*b* are installed at the outer wall 38 of the cylindrical body 34 having a diameter slightly smaller than a circumference which links the ridges 22*a* of the roulette-shaped spiral 22 of the base cylinder 20. Because these engagement projections 37*a* and 37*b* are spirally engaged with the roots 22*b* of the roulette-shaped spiral 22, at the time of a clutch rotation, the engagement projections 37*a* and 37*b* always slip down from the apexes of the ridges 22*a* and do not remain at the ridges 22*a* of the roulette-shaped spiral 22. Therefore, unlike the above-mentioned conventional example shown in FIG. 15, there is not such a case that the projections are left in a state where the projections run on the female screw section, the projections are deformed in a state where the projections are bent inward, and therefore the feeding mechanism itself does not function.

The vertical rib 33 is formed on a surface of the shaft 35 of the core chuck member 30 and the slide groove 12 is arranged in the front cylinder 10, thereby constituting the rotation regulating mechanism by spline engagement. However, the rotation regulating mechanism is not restricted to the method described above. It will be preferable as long as means for synchronously rotating the front cylinder 10 and the core chuck member 30, namely means for engaging the front cylinder 10 and the core chuck member 30 in such a manner that the front cylinder 10 and the core chuck member 30 cannot make relative rotations, are used.

In the stick type cosmetic material feeding container 1, when a rotary load is applied at the feeding advance limit, the engagement projections 37*a* and 37*b* which are installed at the cylindrical body 34 of the core chuck member 30 and have elasticity separate from and are restored to the spiral engagement with the roulette-shaped spiral 22 of the base cylinder 20. Thus, a rotation is made, but a further shift is prevented, and therefore the stick type cosmetic material A and the feeding mechanism are protected. Needless to say, this clutching mechanism is also put into effect in further rotations to cause the core chuck member 30 to retreat at the retreat limit, in other words, in a state where a rear end part 34*b* of the core chuck member 30 is in contact with a bottom surface 24 of the base cylinder 20 as shown in FIG. 1.

Heretofore, in a clutch rotation which is made at the retreat limit, operation of pushing up the core chuck member 30 in a direction of the front end of the front cylinder 10 has been accelerated due to an oscillation which arises when a male screw climes over a spiral linear of a female screw, and there has been a phenomenon such that the stick type cosmetic material A which fits in the stick type cosmetic material retaining section 31 swerves in a direction of advance.

In order to prevent the stick type cosmetic material A from swerving in a direction of advance which may arise due to a shock at the time of a clutch rotation, in the stick type cosmetic material feeding container 1 according to the present invention, the hooked elastic slit 34*c* is formed at a part of the cylindrical body 34 of the core chuck member 30 so as to constitute a shock absorbing section, and therefore the shock acceleration described above is attenuated.

The hooked elastic slit 34*c* comprises a vertical groove which is provided on an outer circumferential surface of the cylindrical body 34 and extends in an axial direction and horizontal grooves which are orthogonal to the axial direction and mutually extend in the opposite directions from both ends of the vertical groove. Thus, elasticity is imparted to the cylindrical body 34, and the acceleration and oscillation which act in an axial direction can be absorbed. As is shown in the drawing, the hooked elastic slit 34*c* comprises a generally helical portion of the cylindrical body 34.

A phenomenon which the stick type cosmetic material swerves in a direction of advance from the stick type cosmetic material retaining section 31 due to a clutch rotation at the stroke retreat limit and means for preventing the swerving phenomenon will be described in detail.

Figure 6:
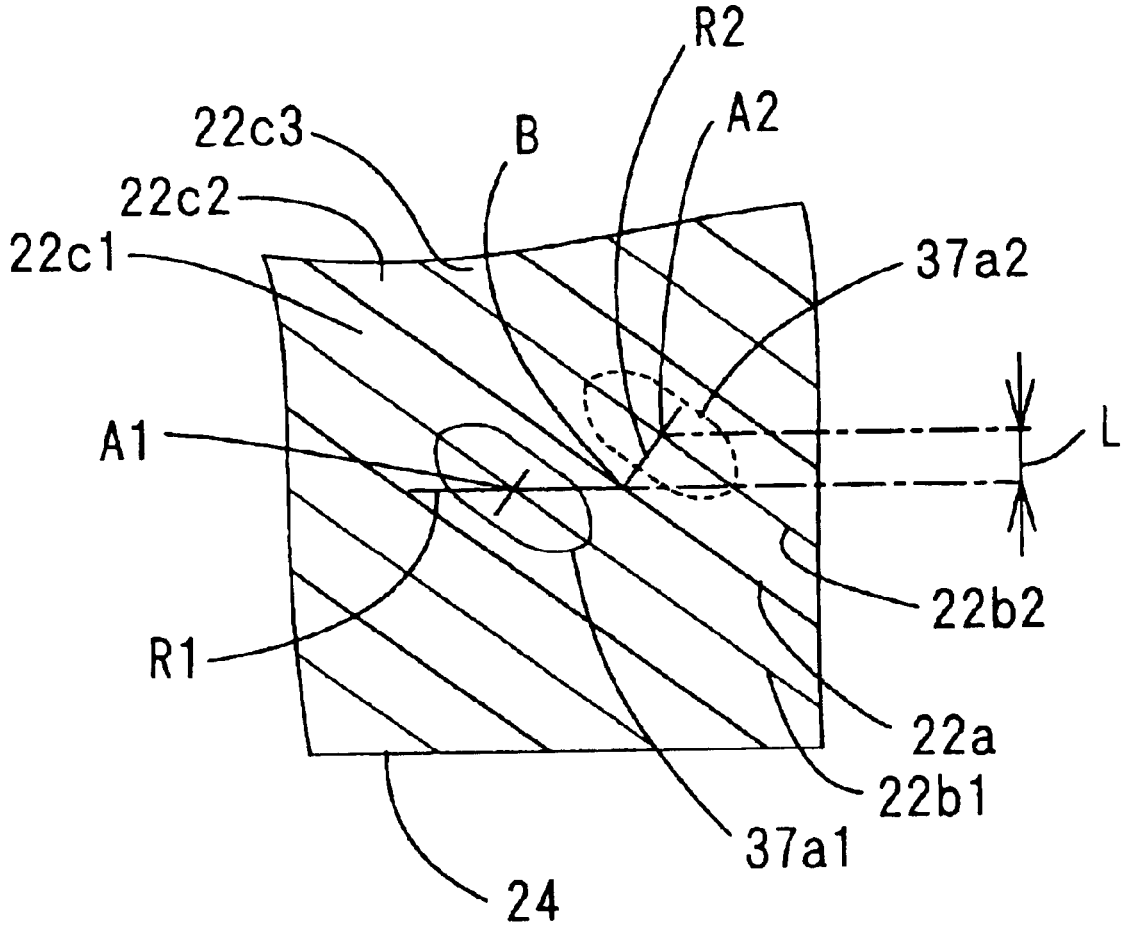
FIG. 6 is a typical drawing showing a state in which an engagement projection goes over a ridge of a screw and moves to the next root at the retreat limit.

FIG. 6 is a typical drawing showing a state in which a rear end part of the core chuck member 30 is in contact with the bottom surface 24 of the base cylinder 20 at the stroke retreat limit.

If the front cylinder 10 is rotated with respect to the base cylinder 20 in a direction of retracting the core chuck member 30 at the retreat limit, the core chuck member 30 cannot move in a direction of the rear end. Thus, an apex A1 of an engagement projection 37*a*1 (the engagement projection 37*a* located at this particular position) will move to an apex B of the ridge 22*a* along a bevel 22*c*1 of the ridge 22*a* on a line R1 which is parallel to the bottom surface 24 of the base cylinder 20. Further, if the fraction 39*a* bends toward the inside of the cylindrical body 34 at this time, a resiliency will be stored.

Next, after the apex A1 of the projection 37*a*1 climbs over the apex B of the ridge 22*a*, the engagement projection 37*a* moves in a direction of the line R2 under the guidance of a bevel 22*c*2 due to the resiliency stored by the bend of the fraction 39*a*. Further, the engagement projection 37*a* comes into contact with a bevel 22*c*3 and an engagement projection 37*a*2 (the engagement projection 37*a* located at this particular position) which is shown by a dotted line stops at the location of a root 22*b*2.

At this time, the engagement projection 37*a* has moved in a direction of the front end by a distance L.

Therefore, in case of the core chuck member of FIG. 7(A) according to the present invention which does not have the elastic slit 34*c* similarly to the conventional example, when the engagement projection moves by the distance L, the whole core chuck member and the stick type cosmetic material A are accelerated in a direction of the front end. Thus, both of the core chuck member 30 and the stick type cosmetic material A have a large momentum, respectively, just before the engagement projection comes into contact with a bevel 22*c*3.

When the engagement projection comes into contact with the bevel 22*c*3, the core chuck member 30 immediately stops, and in the case that the momentum of the stick type cosmetic material A is greater than frictional force to retain the stick type cosmetic material A at the stick type cosmetic material retaining section, the stick type cosmetic material A swerves in a direction of the front end.

Figure 7:
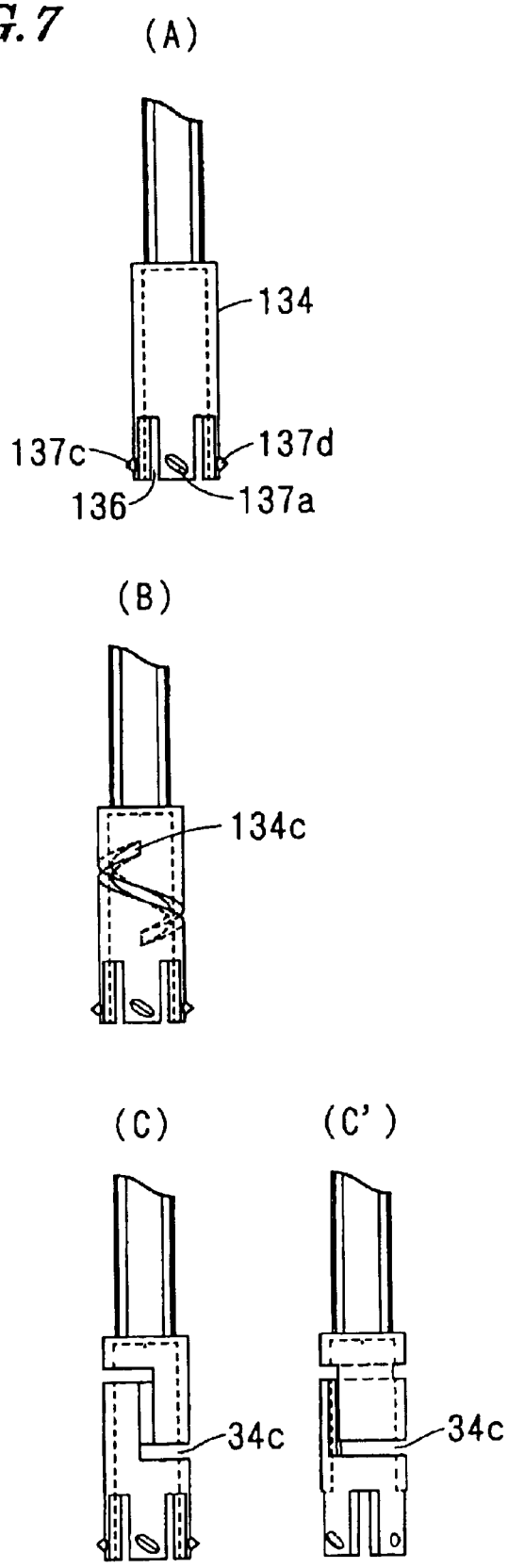
FIG. 7(A) shows a core chuck member without an elastic slit.
FIGS. 7(B) and 7(C) show a core chuck member at which an elastic slit is provided, respectively.

On the other hand, in the core chuck member 30 having the cylindrical body 34 with the hooked elastic slit 34*c* which is given in the embodiment of the present invention and shown in FIGS. 7(C') and 7(C), even though the engagement projection moves by the distance L, the elastic slit instantaneously bends in such a manner that the elastic slit is crushed. Therefore, the moving velocity of the engagement projection on the bevel 22*c*2 is not directly conveyed to the stick type cosmetic material retaining section and the stick type cosmetic material. FIG. 7(B) shows a spiral elastic slit 134*c*.

Further, also when the engagement projection comes into contact with the bevel 22*c*3, the engagement projection itself makes a sudden stop, but the elastic slit bends and absorbs the shock, and therefore it is possible to prevent the stick type cosmetic material from swerving in a direction of advance from the stick type cosmetic material retaining section.

As described above, according to the present invention, the elastic slit 34*c* formed at a rear part of the shaft of the core chuck member 30 eases the shock which is applied to the core chuck member 30 at the time of a clutch rotation at the retreat limit. Thus, it is possible to make a clutch rotation at the feeding retreat limit without causing the stick type cosmetic material to swerve in a direction of advance from the stick type cosmetic material retaining section 31 which is formed at a front end of the core chuck member 30.

FIGS. 8 through 11 show a second embodiment of the present invention.

Reference numerals attached to the respective members of the drawings are increased by 100 over the reference numerals used for the identical members in the first embodiment.

Like the stick type cosmetic material feeding container 1, also in a stick type cosmetic material feeding container 101, a core chuck member 130 inserted slides in the stick type cosmetic material feeding container 101 due to mutual rotations of a base cylinder 120 and a pinch section 110*a* of a front cylinder 110. Thus, a stick type cosmetic material B retained by a stick type cosmetic material retaining section 131 which is formed at a front end of the core chuck member 130 advances and retreats through a front end opening hole 111 of the front cylinder 110, whereby it is possible to put on makeup.

The front end opening hole 111 of the front cylinder 110 of the stick type cosmetic material feeding container 101 has an aperture through which the stick type cosmetic material B slides with a slight space being left between the aperture and the stick type cosmetic material B. The front end opening hole 111 is bored in the almost same size as that of a through hole 113 which leads out of the front end opening hole 111.

Four slide grooves are provided in an axial direction along the through hole 113 on an inner circumferential surface of the through hole 113.

Further, a bend piece 116 is formed, due to a rectangular slit 18, at a front cylinder fit-in section 110*b* of the front cylinder 110 which fits in the base cylinder 120, and a projection 117 is installed on the bend piece 116. The projection 117 comes into contact with an inner circumferential surface 126 of the base cylinder 120 and frictional resistance arises at the time of rotations of the front cylinder 110 and the base cylinder 120.

Four claws 132 which constitute the stick type cosmetic material retaining section 131 are arranged at a front end of the core chuck member 130. These claws 132 are located at slide grooves 112 of the front cylinder 110, respectively.

Linear projections 133 are installed at an outer circumference of a shaft 135, which extends from the core chuck member 130, in such a manner that the linear projections 133 extend from the locations same as those of the claws 132. As shown in FIG. 10(B), a cross section of the shaft 135 is formed in the shape of a cross. The shaft 135 and the linear projections 133 are engaged with a through hole 113 including the slide grooves 112 of the front cylinder 110, thereby constituting a rotation regulating mechanism.

A cylindrical body 134 whose diameter is larger than that of the shaft 135 is installed at a rear part of the core chuck member 130. Also, a slit formed in the shape of a spiral, namely a spiral elastic slit 134*c*, is provided at an outer wall 138 of the cylindrical body 134 in the same direction as that of a roulette-shaped spiral 122 of the base cylinder 120, thereby constituting a shock absorbing section. As is shown in the drawing, the spiral elastic slit 134*c* comprises a generally helical portion of the cylindrical body 134.

Further, at the lower part of the cylindrical body 134, engagement projections 137*a* to 137*d* are installed on surfaces of four fractions 139*a* to 139*d* which are formed among four longitudinal notches 136*a* to 136*d*. The engagement projections 137*a* to 137*d* are spirally engaged with the roulette-shaped spiral 122 and therefore a feeding mechanism is constituted.

The base cylinder 120 has the constitution similar to that of the base cylinder 20 of the stick type cosmetic material feeding container 1 shown in FIG. 5. The base cylinder 120 has at its front end inner diameter a fit-in concave section 121 in which the front cylinder 110 fits, and also the roulette-shaped spiral 122 which is longer than a stroke length is formed in an axial direction up to a bottom surface 124.

With respect to the stick type cosmetic material feeding container 101, when the stick type cosmetic material B enters among the claws 132 located at the slide grooves 112 of the front cylinder 110, projections 132*a* installed on back surfaces of the claws 132 come into contact with slide surfaces 112*a* and the stick type cosmetic material B is retained with a fixed force from the circumference while the claws 132 are prevented from expanding further.

Contact of the projections 132*a* with the slide surfaces 112*a* is made during the stroke of the claws 132 and therefore the stick type cosmetic material B is securely retained.

FIG. 9(A) shows a state in which the stick type cosmetic material B is retained by the four claws 132 and also the stick type cosmetic material B is retained by inner circumferential surfaces 112*b* in an axial direction.

Further, FIG. 9(C) shows a state in which the four engagement projections 137*a* to 137*d* installed at the four fractions 139*a* to 139*d* to be formed among the notches 136*a* to 136*d* are elastically and spirally engaged with roots 122*b* of the roulette-shaped spiral 122.

Operation of the stick type cosmetic material feeding container 101 is as follows.

Figure 10:
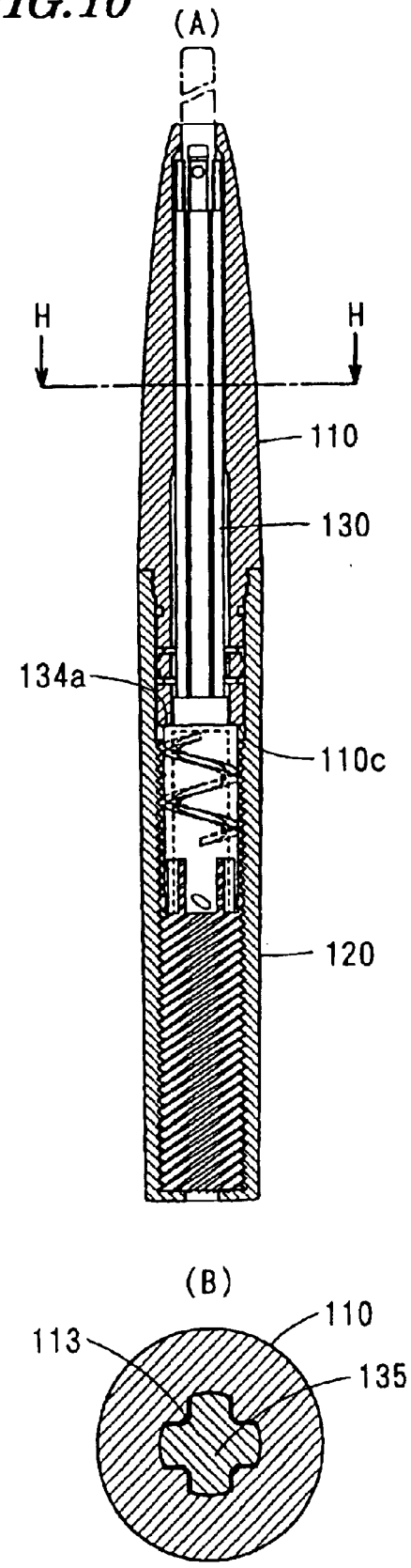
FIG. 10(A) is a partially longitudinal section showing the second embodiment.
FIG. 10(B) is a sectional view taken along line H—H of FIG. 10(A).
Figure 11:
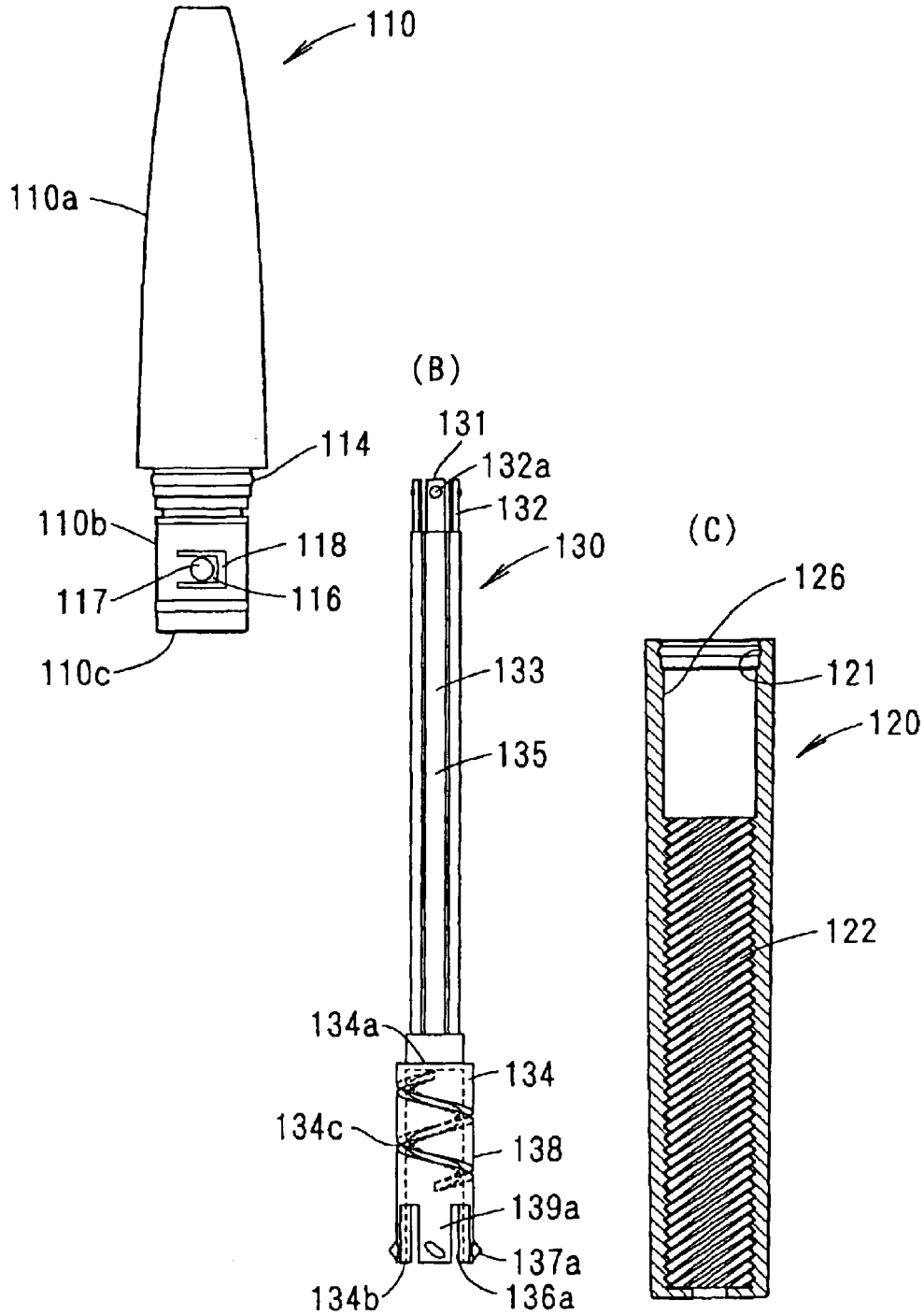
FIG. 11 is a partially longitudinal section showing each part of the second embodiment.

Due to mutual rotations of the front cylinder 110 and the base cylinder 120, feeding operation of the stick type cosmetic material is carried out. More specifically, as shown in FIG. 10 (B), the shaft 135 is engaged with the through hole 113 including the slide grooves 112 of the front cylinder 110 leaving almost no space between the shaft 135 and the through hole 113, thereby constituting the rotation regulating mechanism. Also, as shown in FIG. 9(C), the engagement projections 137*a* to 137*d* installed at the outer wall 138 of the cylindrical body 134 of the core chuck member 130 are spirally engaged with the roots 122*b* of the roulette-shaped spiral 122 of the base cylinder 120, thereby constituting the feeding mechanism. Thus, due to relative rotations of the front cylinder 110 and the base cylinder 120, the stick type cosmetic material B is advanced through the front end opening hole 111 of the front cylinder 110 and therefore it is possible to use a cosmetic material.

FIG. 10 shows the advance limit of the feeding stroke, and a front end section 134*a* of the cylindrical body 134 of the core chuck member 130 comes into contact with a rear end part 110*c* of the front cylinder 110, whereby the feeding advance limit is defined. However, it is designed so that front ends of the claws 132 do not come into contact with stepped sections 115 of the slide grooves 112.

Also, when a further rotary load for advance rotations is applied, the engagement projections 137*a* to 137*d* easily separate from the spiral engagement with the roots 122*b* of the roulette-shaped spiral 122 and a clutch rotation starts.

Further, if the front cylinder 110 and the base cylinder 120 are rotated in reverse to the above, the engagement projections 137*a* to 137*d* immediately return to the spiral engagement with the roots 122*b* of the roulette-shaped spiral 122, and the stick type cosmetic material B is housed in the front cylinder 110.

Figure 8:
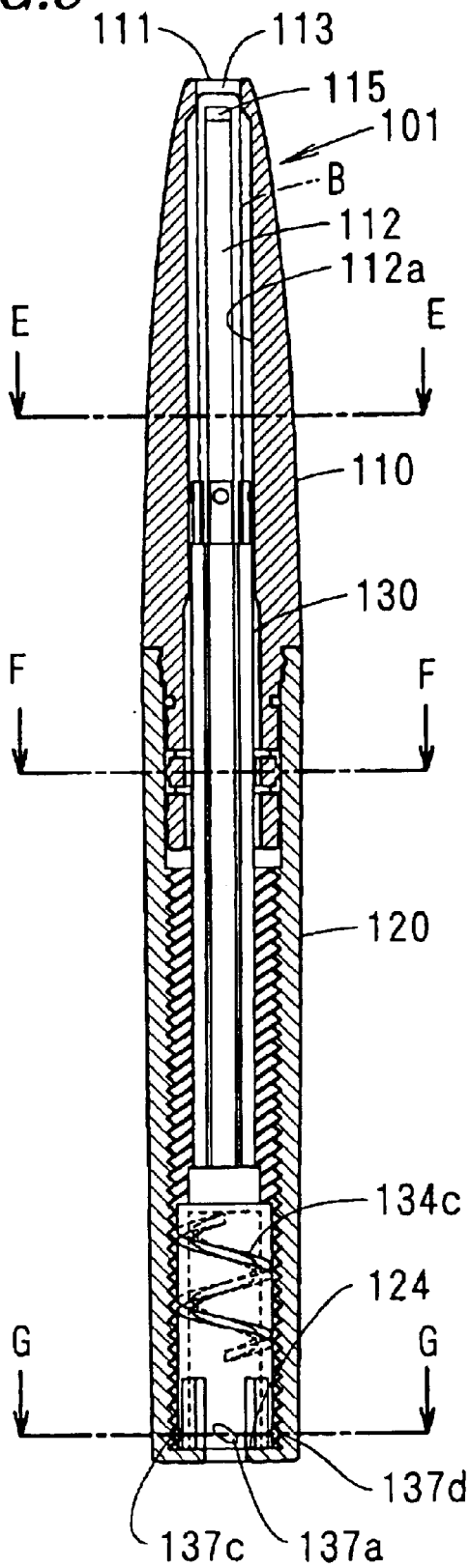
FIG. 8 is a partially longitudinal section showing a second embodiment of the present invention.
Figure 9:
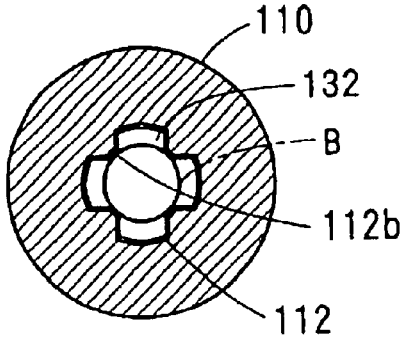
FIG. 9(A) is a sectional view taken along line E—E of FIG. 8.
FIG. 9(B) is a sectional view taken along line F—F of FIG. 8.
FIG. 9(C) is a sectional view taken along line G—G of FIG. 8.
Figure 9:
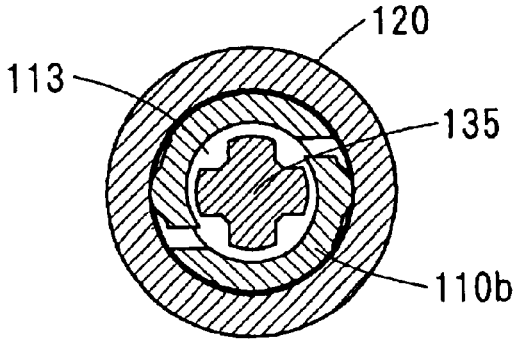
Figure 9:
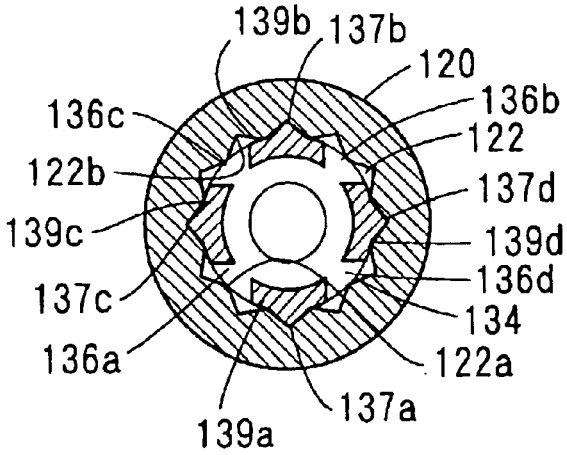

Further, when a further rotary load in a direction of retreat to retract the core chuck member 130 is applied in a state of the retreat limit shown in FIG. 8, the engagement projections 137*a* to 137*d* separate from the spiral engagement with the roots 122*b* of the roulette-shaped spiral 122 of the base cylinder 120 and generate an oscillation to the core chuck member 130. However, the spiral elastic slit 134*c* formed at the outer wall 138 of the cylindrical body 134 absorbs a reaction which arises resulting from the oscillation and therefore the stick type cosmetic material B is prevented from swerving in a direction of advance among the claws 132.

The spiral elastic slit 134*c* is a slit spiral (either of a single thread and a double thread is applicable) which is formed in the same direction as that of the roulette-shaped spiral 122 formed at the base cylinder 120, and the cylindrical body 134 has elasticity. Thus, the oscillation of the core chuck member 130 is absorbed.

Further, it is preferable that the slit is longer than a semicircle and provided in a direction of circumference.

As described above, it is possible to prevent the core chuck member 130 from swerving in a direction of advance at the time of a clutch rotation at the retreat limit by forming the spiral elastic slit 134*c*. However, the present invention is not restricted to the spiral slit 134*c*. It will be sufficient if the cylindrical body 134 has shock relaxation means for preventing the core chuck member 130 from swerving in a direction of advance at the time of a clutch rotation at the retreat limit.

In the second embodiment, the stick type cosmetic material B is retained among the plurality of claws 132 formed at a front end of the core chuck member 130, and because these claws 132 are located at the slide grooves 112 in the front cylinder 110, the stick type cosmetic material B is also supported in an axial direction by the inner circumferential surfaces 112*b* of the front cylinder 110 among the slide grooves 112. Therefore, it is possible to provide a feeding container which is resistant to an external shock, such as a drop, an oscillation, and the like and also has an outward appearance of small diameter.

Further, due to the spiral elastic slit 134*c* which is formed in an axial direction of the outer wall 138 of the cylindrical body 134 of the core chuck member 130 and has the same slope as that of the roulette-shaped spiral 122 in the base cylinder 120, in the clutch rotation at the feeding retreat limit, swerve of the stick type cosmetic material B from the cosmetic material retaining section 131 is prevented by easing the reaction.

Further, the notches 136*a* to 136*d* are provided at a lower end of the cylindrical body 134, and engagement projections 137 of the cylindrical body 134 are arranged on a circumference of the cylindrical body 134 as the four engagement projections 137*a* to 137*d*. Thus, the engagement projections 137*a* to 137*d* can securely and spirally be engaged with the roots 122*b* of the roulette-shaped spiral 122 of the base cylinder 120.

Figure 12:
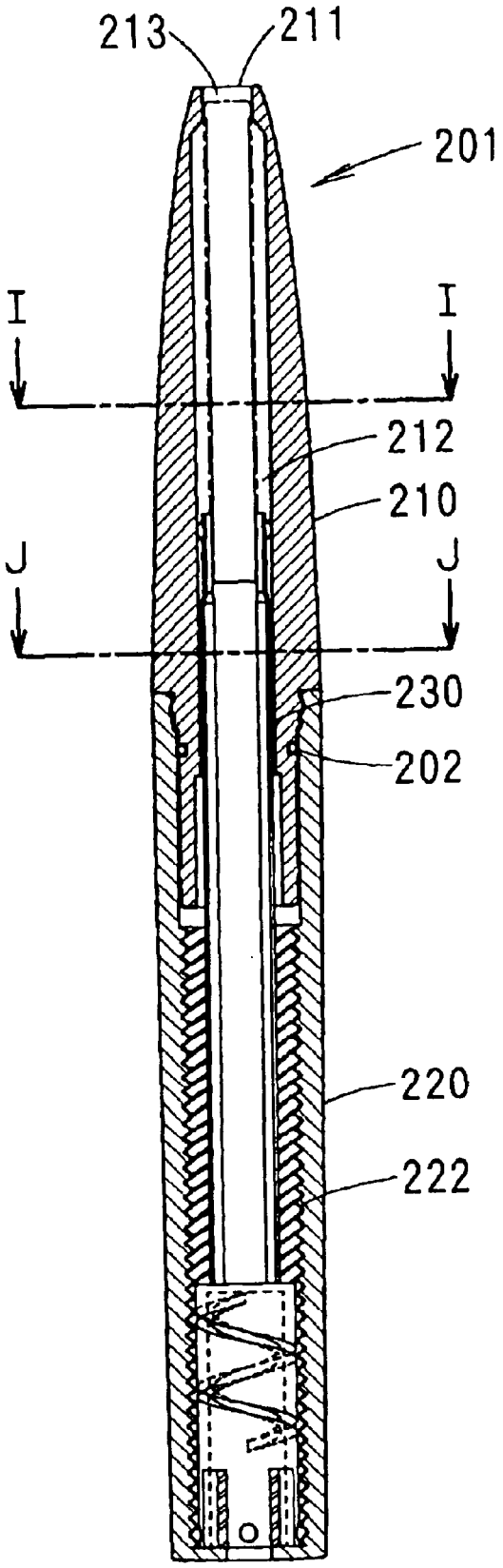
FIG. 12 is a partially longitudinal section showing a third embodiment of the present invention.
Figure 13:
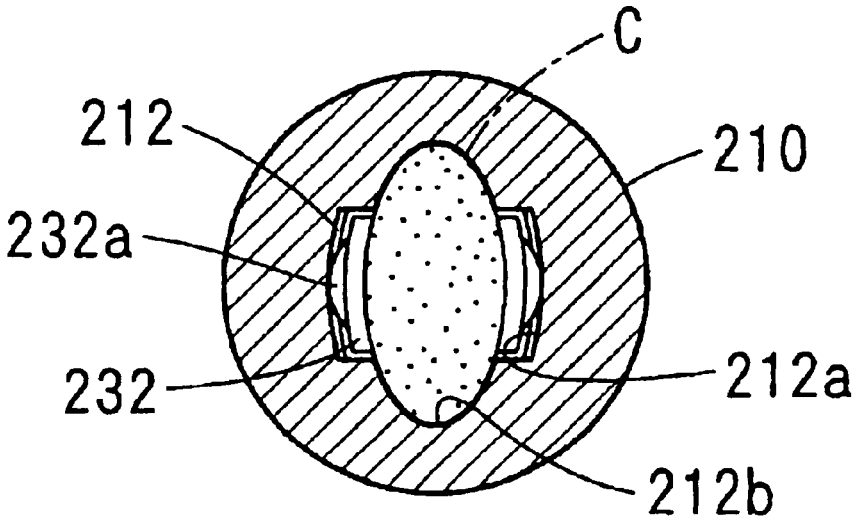
FIG. 13(A) is a sectional view taken along line I—I of FIG. 12.
FIG. 13(B) is a sectional view taken along line J—J of FIG. 12.
Figure 13:
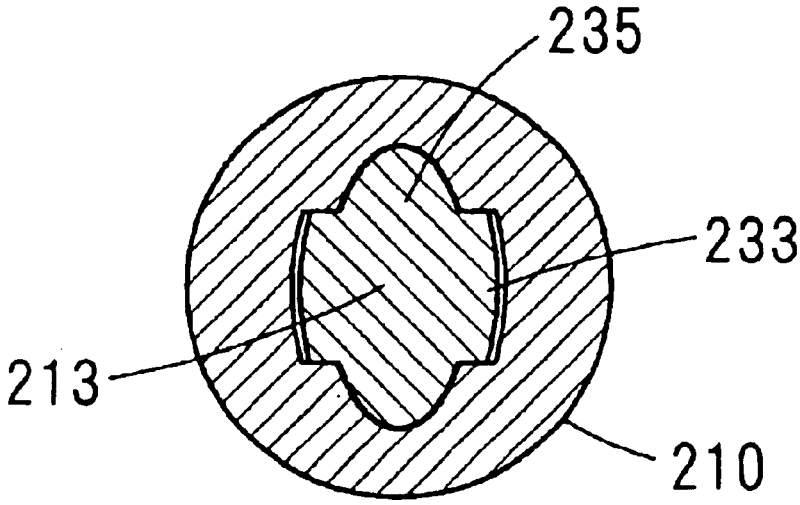
Figure 14:
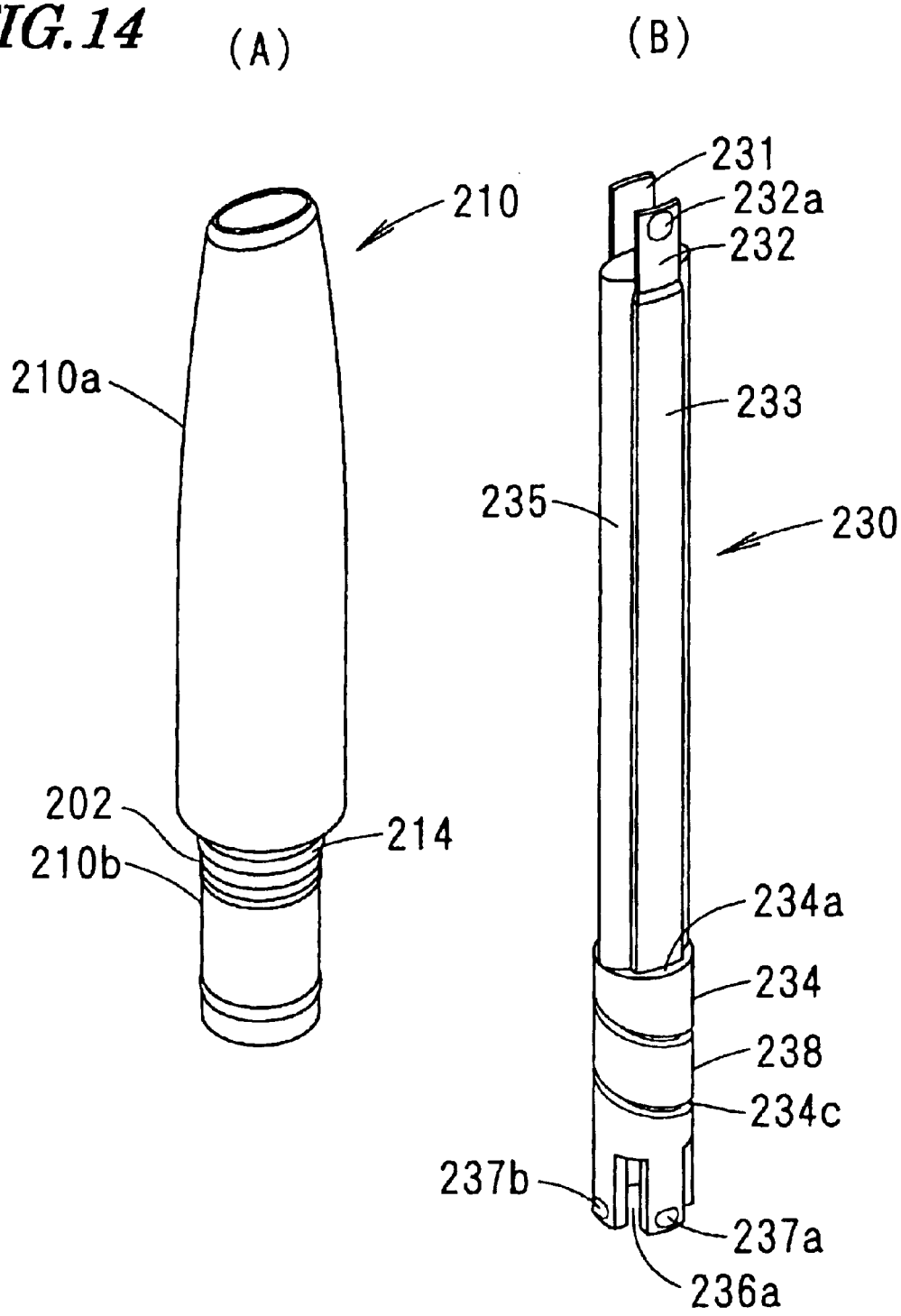
FIG. 14 is a single view drawing of a front cylinder and a core chuck member according to the third embodiment.

FIGS. 12 to 14 show a third embodiment of the present invention.

Reference numerals used in these drawings are increased by 200 over the reference numerals attached to the identical members in the first embodiment.

As shown in FIGS. 14(A) and 14(B), at a front cylinder 210, an elliptical front end opening hole 211 through which an elliptical stick type cosmetic material C advances and retreats is provided and an elliptical through hole 213 which has almost the same dimensions as those of the front end opening hole 211 is bored.

Further, a pair of slide grooves 212 are provided on the major axis side of the ellipse of the through hole 213 (refer to FIG. 13). Further, an O-ring 202 is wound to a base cylinder fit-in section 210*b* besides a fit-in convex section 214 to be used for connection with a base cylinder 220 and therefore appropriate slide friction is caused to arise on an inner circumferential surface of the base cylinder 220.

A core chuck member 230 has at its front end a pair of claws 232 as a stick type cosmetic material retaining section 231, and a pair of linear projections 233 extending in an axial direction are arranged below the claws 232 and on the major axis side of an elliptical shaft 235.

FIG. 13(A) shows a state in which the stick type cosmetic material C is retained among the claws 232. The stick type cosmetic material C is retained on the major axis side of the ellipse by the pair of claws 232 and projections 232*a* provided on back surfaces of the claws 232 are always in contact with slide surfaces 212*a* of the slide grooves 212 of the front cylinder 210. Thus, the stick type cosmetic material C is retained.

Further, parts of the stick type cosmetic material C other than the claws 232 are in contact with an inner circumferential surface 212*b* of the front cylinder 210 and retained by the inner circumferential surface 212*b*. Thus, the stick type cosmetic material C is always retained on the straight in the front cylinder 210. This enables the container to have a smaller outside diameter and also breakage or damage which may arise resulting from an external shock is prevented.

FIG. 13(B) is a sectional view taken along line J—J of FIG. 12. The shaft 235 of the core chuck member 230 is engaged with the through hole 213 of the front cylinder 210 including the slide grooves 212 leaving a slight space between the shaft 235 and the through hole 213, thereby constituting a mutual rotation regulating mechanism. In addition, the shaft 235 can be a member having a larger diameter and therefore the shaft 235 will not be twisted.

Notches 236*a* to 236*d* are provided at an outer wall 238 of a cylindrical body 234 of the core chuck member 230 and engagement projections 237*a* to 237*d* are installed among these notches 236*a* to 236*d*. The engagement projections 237*a* to 237*d* are spirally engaged with the roulette-shaped spiral 122 of the base cylinder 120, thereby constituting a feeding mechanism. Further, a spiral elastic slit 234*c* is formed at the cylindrical body 234. Thus, not only at the time of a clutch rotation at the advance limit, but also at the time of a clutch rotation at the retreat limit, acceleration in an axial direction which is imparted to the cylindrical body 234 is attenuated, whereby it is possible to effectively prevent the stick type cosmetic material from coming out of the core chuck member 230.

Further, in the present invention, even though the stick type cosmetic material feeding container 1 drops and hits against the floor tip-first, the shock can be absorbed by the elastic slit. Therefore, a large momentum to move the stick type cosmetic material from the stick type cosmetic material retaining section in a direction of the front end will not arise at the stick type cosmetic material. In other words, the elastic slit according to the present invention makes it possible to prevent the stick type cosmetic material from falling off from the stick type cosmetic material retaining section not only at the time of a clutch rotation, but also in such a case that the stick type cosmetic material feeding container drops to the floor.

Therefore, according to the present invention, it is possible to provide the stick type cosmetic material feeding container into which not only a circular stick type cosmetic material A or B, but also a modified core, such as an elliptical core or a square-shaped core can fit and which has a safety mechanism against a rotary load at the feeding advance limit and the feeding retreat limit and is composed of less components.

It is obvious that the present invention is not restricted to the embodiments described above and includes various improvements and modifications within a scope of the claims of the invention.

What is claimed is:

1. A stick type cosmetic material feeding container comprising:

a front cylinder and a base cylinder coaxially connected in such a manner that the front cylinder and the base cylinder are freely rotatable relative to one another, a core chuck member comprising a stick type cosmetic material retaining section retaining a stick of cosmetic material, the core chuck member being disposed in the front cylinder; and a feeding mechanism causing the core chuck member to make a feeding stroke in an axial direction due to relative rotations of the front cylinder and the base cylinder, the feeding mechanism including:

a spiral groove formed on an inner circumferential surface of the base cylinder;

a shaft extending from the stick type cosmetic material retaining section;

a cylindrical body which is disposed at an edge of the shaft, comes into contact with a part of the front cylinder and a part of the base cylinder at an advance limit and a retreat limit of a feeding stroke of the core chuck member, respectively, and thereby defines the advance limit and the retreat limit, respectively;

an engagement projection which is installed at an outer circumference of the cylindrical body and elastically and spirally engages with the spiral groove; and a shock absorbing section which is comprised in the cylindrical body and which absorbs a shock in an axial direction, wherein when the engagement projection goes over the spiral groove and makes a clutch rotation due to a further rotary load on the core chuck member at least at the retreat limit of the core chuck member, the shock absorbing section absorbs a shock in an axial direction to the core chuck member which has arisen resulting from the clutch rotation.

2. The stick type cosmetic material feeding container according to claim 1, wherein the spiral groove is formed as a roulette-shaped spiral, an outside diameter of the cylindrical body is slightly smaller than an inside diameter of the roulette-shaped spiral in the base cylinder, and the engagement projection is spirally engaged with a root of the roulette-shaped spiral.

3. A stick type cosmetic material feeding container comprising:

a front cylinder and a base cylinder coaxially connected in such a manner that the front cylinder and the base cylinder are freely rotatable relative to one another, a core chuck member comprising a stick type cosmetic material retaining section retaining a stick of cosmetic material, the core chuck member being disposed in the front cylinder; and a feeding mechanism causing the core chuck member to make a feeding stroke in an axial direction due to relative rotations of the front cylinder and the base cylinder, the feeding mechanism including:

a spiral groove formed on an inner circumferential surface of the base cylinder;

a shaft extending from the stick type cosmetic material retaining section;

a cylindrical body which is disposed at an edge of the shaft, comes into contact with a part of the front cylinder and a part of the base cylinder at an advance limit and a retreat limit of a feeding stroke of the core chuck member, respectively, and thereby defines the advance limit and the retreat limit, respectively;

an engagement projection which is installed at an outer circumference of the cylindrical body and elastically and spirally engages with the spiral groove; and a shock absorbing section which is comprised in the cylindrical body and which absorbs a shock in an axial direction, wherein when the engagement projection goes over the spiral groove and makes a clutch rotation due to a further rotary load on the core chuck member at least at the retreat limit of the core chuck member, the shock absorbing section absorbs a shock in an axial direction to the core chuck member which has arisen resulting from the clutch rotation;

wherein the spiral groove is formed as a roulette-shaped spiral, an outside diameter of the cylindrical body is slightly smaller than an inside diameter of the roulette-shaped spiral in the base cylinder, and the engagement projection is spirally engaged with a root of the roulette-shaped spiral; and wherein the engagement projection is disposed on a fraction provided between a pair of parallel slits which are inclined in the same direction as that of a slope of the roulette-shaped spiral of the base cylinder.

4. The stick type cosmetic material feeding container according to claim 2, wherein the engagement projection is disposed on a fraction provided among a plurality of slits which extend in an axial direction at an edge of the cylindrical body.

5. The stick type cosmetic material feeding container according to claim 1, wherein the shock absorbing section comprises a hooked slit formed in the cylindrical body.

6. The stick type cosmetic material feeding container according to claim 5, wherein the hooked slit comprises a generally helical portion of the cylindrical body.

7. The stick type cosmetic material feeding container according to claim 6, wherein wherein the hooked slit comprises an elastic slit which bends in such a manner that the elastic slit is crushed when the engagement projection goes over the spiral groove and makes a clutch rotation.

8. The stick type cosmetic material feeding container according to claim 1, wherein the shock absorbing section comprises a spiral slit formed in the cylindrical body.

9. The stick type cosmetic material feeding container according to claim 8, wherein the spiral slit comprises a generally helical portion of the cylindrical body.

10. The stick type cosmetic material feeding container according to claim 9, wherein wherein the spiral slit comprises an elastic slit which bends in such a manner that the elastic slit is crushed when the engagement projection goes over the spiral groove and makes a clutch rotation.

11. The stick type cosmetic material feeding container according to claim 1, including a plurality of slide grooves extending in an axial direction comprised in the front cylinder, and a plurality of claws for retaining the stick type cosmetic material comprised in the stick type cosmetic material retaining section at a front end of the core chuck member, and wherein the claws are located at the plurality of slide grooves in the front cylinder and guide the core chuck member so that the core chuck member can move only in an axial direction along an inner circumference of the front cylinder.

* * * * *